US007017477B1

(12) United States Patent
Viljanmaa et al.

(10) Patent No.: US 7,017,477 B1
(45) **Date of Patent: *Mar. 28, 2006**

(54) METHOD AND ARRANGEMENT FOR COMPUTING AND REGULATING THE DISTRIBUTION OF A LINEAR LOAD IN A MULTI-NIP CALENDER AND A MULTI-NIP CALENDER

(75) Inventors: Mika Viljanmaa, Espoo (FI); Pekka Linnonmaa, Järvenpää (FI); Ilkka Hiirsalmi, Espoo (FI); Pekka Koivukunnas, Järvenpää (FI); Tapio Mäenpää, Helsinki (FI); Erkki Leinonen, Järvenpää (FI); Pekka Kivioja, Muurame (FI); Juha Ehrola, Vaajakoski (FI)

(73) Assignee: Metso Paper, Inc., Helsinki (FI)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 09/303,587

(22) Filed: May 3, 1999

Related U.S. Application Data

(63) Continuation of application No. 09/156,232, filed on Sep. 18, 1998, now abandoned, which is a continuation-in-part of application No. 09/074,723, filed on May 7, 1998, now abandoned.

(60) Provisional application No. 60/045,871, filed on May 7, 1997.

(51) Int. Cl.
*B30B 3/04* (2006.01)

(52) U.S. Cl. ..... 100/35; 100/168

(58) Field of Classification Search ..... 100/35, 100/162 B, 168, 172
See application file for complete search history.

(56) References Cited

U.S. PATENT DOCUMENTS

| | | | | | |
|---|---|---|---|---|---|
| 4,597,326 | A | * | 7/1986 | Kultaranta | 100/162 B |
| 4,625,637 | A | * | 12/1986 | Pav et al. | 100/162 B |
| 4,644,860 | A | * | 2/1987 | Brendel | 100/162 B |
| 4,903,517 | A | * | 2/1990 | Van Haag et al. | 100/162 B |
| 4,936,207 | A | * | 6/1990 | Niskanen et al. | 100/162 B |
| 5,029,521 | A | * | 7/1991 | Pav et al. | 100/162 B |
| 5,226,357 | A | * | 7/1993 | Schiel | 100/162 B |
| 5,343,801 | A | * | 9/1994 | Schiel | 100/162 B |
| 5,438,920 | A | * | 8/1995 | Koivukunnas et al. | 100/162 B |
| 5,662,037 | A | * | 9/1997 | Van Haag | 100/162 B |
| 5,791,242 | A | * | 8/1998 | Kayser et al. | 100/162 B |
| 6,129,011 | A | * | 10/2000 | Cramer | 100/162 B |

* cited by examiner

*Primary Examiner*—Louis Huynh
(74) *Attorney, Agent, or Firm*—Steinberg & Raskin, P.C.

(57) ABSTRACT

A method and arrangement for computing and regulating distribution of linear load in a multi-nip calender. A material web is passed through the nips in a set of rolls including a variable-crown upper roll, a variable-crown lower roll and intermediate rolls positioned between the upper and lower rolls. The rolls in the set of rolls are supported so that, when the nips are closed, the bending lines of the rolls are curved downwards. When computing and regulating the linear loads, one or more of the physical properties affecting the bending of each intermediate roll under load, such as bending rigidity, mass, shape, and material properties, are taken into account. The ratio of the linear loads applied to the intermediate rolls, the weight of the rolls per se, and/or the support forces applied to the rolls are regulated so that the set of rolls is in a state of equilibrium and a predetermined state of deflection.

11 Claims, 8 Drawing Sheets

METHOD AND ARRANGEMENT FOR COMPUTING AND REGULATING THE DISTRIBUTION OF A LINEAR LOAD IN A MULTI-NIP CALENDER AND A MULTI-NIP CALENDER

CROSS-REFERENCE TO RELATED APPLICATIONS

This application is a continuation of U.S. patent application Ser. No. 09/156,232 filed Sep. 18, 1998, now abandoned, which in turn is a continuation-in-part of U.S. patent application Ser. No. 09/074,723 filed May 7, 1998, now abandoned, which claims domestic priority of U.S. Provisional Patent Application Serial No. 60/045,871 filed May 7, 1997.

FIELD OF THE INVENTION

The present invention relates to a method for computing and regulating the distribution of linear load in a multi-nip calender, wherein a material web to be calendered is passed through the nips in a set of rolls that is placed in a substantially vertical position. The set of rolls is formed by a variable-crown upper roll, a variable-crown lower roll and by at least two intermediate rolls provided with support cylinders and situated between the upper and lower rolls. All the rolls in the set of rolls are preferably supported so that, when the nips are closed, the bending lines of the rolls are curved downwards.

The present invention also relates to an arrangement for computing and regulating the distribution of linear load in a multi-nip calender intended for calendering paper or board, which calender comprises a set of rolls which is mounted on the frame of the calender in a substantially vertical position and which set of rolls includes a variable-crown upper roll, a variable-crown lower roll as well as one or more intermediate rolls interposed between the upper roll and the lower roll. The means of suspension of the intermediate rolls are provided with support cylinders, and all the rolls in the set of rolls are preferably supported so that, when the nips are closed, the bending lines of the rolls are curved downwards.

Further, the present invention relates to a multi-nip calender for carrying out the method in accordance with the invention.

BACKGROUND OF THE INVENTION

In conventional supercalenders or multi-nip calenders, when the nips are closed, the set of rolls is supported from outside the zone of treatment of the web by means of forces which are substantially equal to what is called the pin load applied to the bearing housings of the rolls during running, or which forces are lower than the pin load. The pin load is commonly defined so that it includes the weight of all of the auxiliary equipment connected with the bearing housings of the roll, such as gap shields, doctors, and so-called take-out leading rolls, and also the weight of the portion placed outside the web width and the weight of the bearing system. This prior art has been described best in the paper by Rolf van Haag: "Der Weg zum Load Control-System"; Das Papier, 1990, Heft 7, in which the regulation of the linear load in a conventional supercalender is described. In such supercalenders, the rolls are positioned one above the other so that their middle portions are curved upwards or, in a very rare and special case, are fully straight. The intermediate rolls do not bend in the same way, as compared with one another. Owing to the mode of running, the nip loads in the set of calender rolls are such that the roll masses occurring in the area of the web to be calendered always act with full effect upon all the nip loads placed underneath the roll concerned. In such a mode of running, it is assumed that the set of rolls is curved in such a way during running that the rigidities of the rolls do not have a substantial effect on the uniformity of the linear loads, and attempts are made to operate the calender based on this assumption so that exclusively the linear loads of the upper roll and of the lower roll are regulated on the basis of measurements of quality.

In Finnish Patent No. 96,334, corresponding to U.S. Pat. No. 5,438,920 (incorporated by reference herein), a calendering method and a calender that applies the method are described, which calender comprises a variable-crown upper roll, a variable-crown lower roll and a number of intermediate rolls placed between the upper roll and the lower roll in nip contact with each other. The rolls are arranged as a substantially vertical stack of rolls on the frame of the calender.

A material web to be calendered is passed through the nips formed by the adjacent rolls. The nip load produced by the mass of the rolls in the stack of rolls is eliminated in a specific manner so that all the nips in the calender may be loaded with the desired load, which load is, in a preferred alternative embodiment, equally high in all nips. Thus, the calendering potential could be utilized substantially better than in the earlier calenders. In FI 96,334, it is one of the basic ideas of the prior art calender that rolls bending in the same way are employed in the calender. The conduct of such substantially equally bending rolls in the calender and the simple possibility, permitted by such rolls, of relieving the entire mass of the roll are described, in which case this prior art calender and calendering method differ essentially from the first-mentioned German prior art in the very respect that the effect of the masses of the rolls on the linear loads in the lower nips can be regulated freely.

The prior art described above involves an essential problem. If it is assumed that the natural deflections of the intermediate rolls in the calender without linear loads, i.e., when the nips are open, and the rigidities of the rolls as well as the masses are different, first it is to be stated that such rolls do not comply with those described in FI 96,334 or U.S. Pat. No. 5,438,920, in which all of the intermediate rolls had substantially equal deflections. In reality, the manufacture of such rolls, which substantially meet the absolute requirement stated in these publications without separate operations, is very difficult and also expensive, in which connection it has been ascertained that an entirely trivial algorithm of regulation of linear loads, which does not take into account minor differences between the rolls, is not adequate from the point of view of reliable operation of the calender.

OBJECTS AND SUMMARY OF THE INVENTION

Accordingly, it is an object of the present invention to provide a solution for the problems related to the prior art calenders by developing a novel mode of thinking, which takes into account the properties of deflection of the rolls.

Another object is to provide an improvement over the calender concept described in Finnish Patent No. 96,334 and U.S. Pat. No. 5,438,920, in particular in respect of the manner in which the distribution of linear load can be brought under control in the desired way.

In view of achieving these objects and others, in the method in accordance with the invention, in order to compute and regulate the linear loads, one or more of the physical properties affecting the bending of each intermediate roll under load, such as bending rigidity, mass, shape, and material properties, are taken into account, and the ratio of the linear loads applied to the intermediate rolls, the weight of the rolls, and/or the support forces applied to the rolls are regulated so that the set of rolls is in a state of equilibrium and a predetermined state of deflection. Preferably, all of the above-noted physical properties are determined and taken into account and the ratio of linear loads, weight of the rolls and support forces are all regulated.

The arrangement in accordance with the invention includes an automation system and a computing unit arranged to compute and regulate linear loads taking into account the physical properties affecting the bending of each intermediate roll under load, such as bending rigidity, mass, shape, and material properties, and serving to regulate the ratio of the linear loads applied to the intermediate rolls, the weight of the rolls, and the support forces applied to the rolls so that the set of rolls is in a state of equilibrium and in a predetermined state of deflection.

The method in accordance with the invention takes into account the properties of rolls of all types, and thus, in some embodiments of the invention, intermediate rolls are employed in the set of rolls in the calender whose bending properties are different from roll to roll.

In the computing or computation in accordance with the method and the arrangement of the invention, the set of rolls can be treated as a single unit. On the other hand, the computing can also be carried out individually in respect of each pair of rolls.

The intermediate rolls in the set of rolls are freely moving, so that just forces are applied to the rolls, but the rolls are not held in position.

By means of the method and the arrangement in accordance with the invention and by means of the calender intended for carrying out the method, significant advantages are obtained in particular in the respect that, by means of the arrangement in accordance with the invention, the linear loads in each nip can be regulated to the desired level. The arrangement takes into account and computes the deflection lines of the intermediate rolls and the loads of the relief cylinders corresponding to these deflection lines. The rigidities of the intermediate rolls and the differences in the natural deflections of the rolls arising from differences in mass can be readily compensated for in the arrangement by regulating the support forces of the roll support cylinders.

Thus, when an arrangement in accordance with the present invention is employed, the deflection lines of all of the intermediate rolls do not have to be identical. The method and the arrangement of the invention can be applied both with a traditional mode of running of a multi-nip calender, in which the paper web runs through all nips, and to a modified mode of running, in which the paper web is passed through certain, desired nips only.

Further advantages and characteristic features of the invention will come out better from the following detailed description of the invention.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
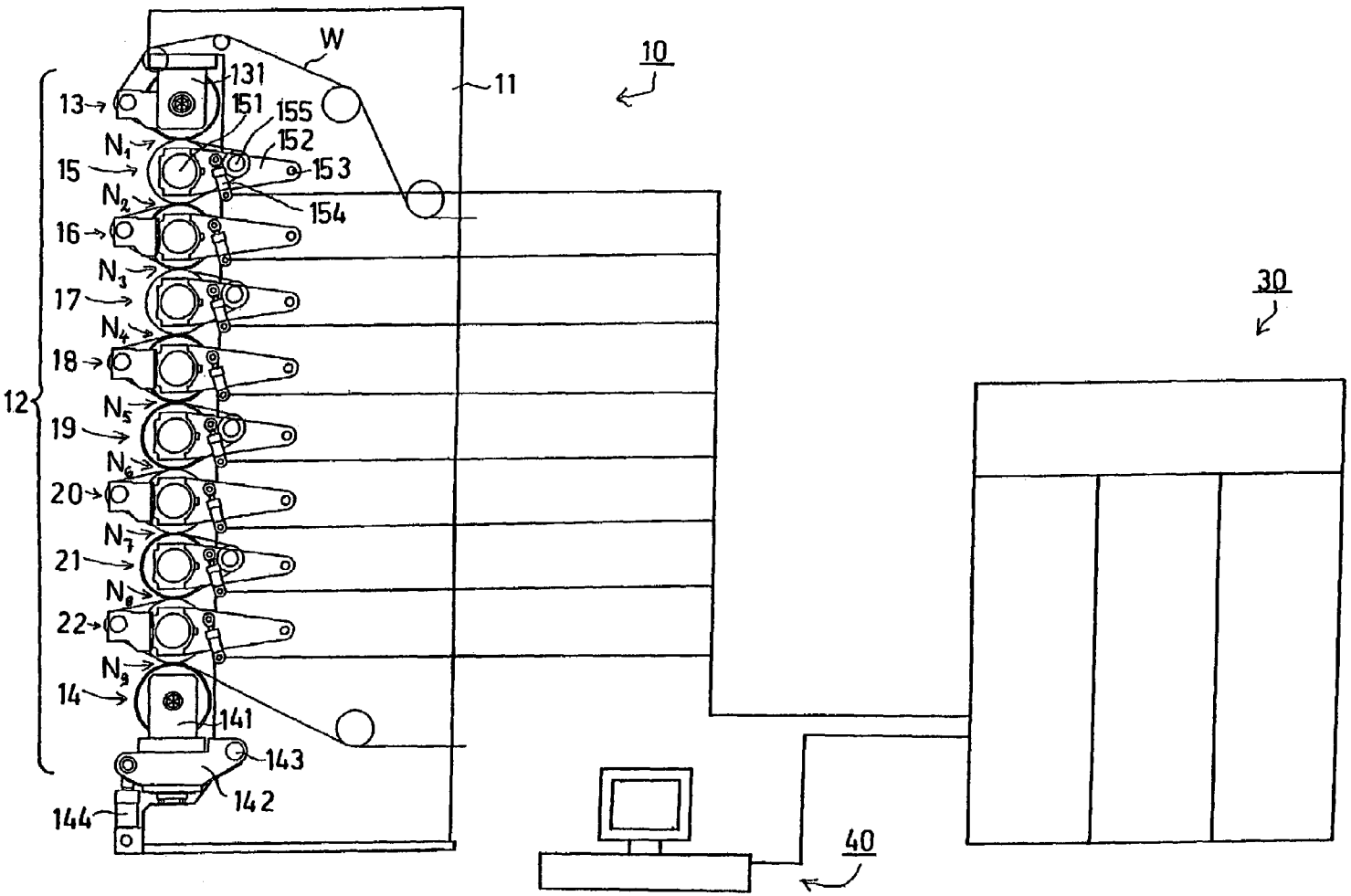
FIG. 1 is a general illustration of the arrangement in accordance with the invention which is applied in a multi-nip calender for computing and regulating the distribution of linear load.

Referring to FIGS. 1–8 wherein like reference numerals refer to the same or similar elements, FIG. 1 is a general view of the arrangement in accordance with the invention in which a calender is denoted generally by reference numeral 10, an automation system is denoted by reference numeral 30, and a computing unit included in the automation system 30 is denoted by reference numeral 40. The calender 10 shown in FIG. 1 has a construction similar to that described, e.g., in Finnish Patent No. 96,334, and thus, the calender 10 comprises a calender frame 11 on which the set of rolls 12 consisting of a number of rolls has been installed substantially in the vertical plane. The set of rolls 12 comprises an upper roll 13, a lower roll 14, and a number of intermediate rolls 15–22 situated between the upper roll 13 and the lower roll 14 one above the other, which rolls are, in the embodiment illustrated in FIG. 1, in nip contact with each other. A paper, board or other material web W is passed over alignment, spreader and take-out leading rolls into the upper nip $N_1$ and further through the other nips $N_2, \ldots, N_8$ in the calender and finally out through the lower nip $N_9$. As shown in FIG. 1, the paper web W is taken, in the gaps between the nips $N_1, \ldots, N_9$, apart from the faces of the calender rolls by means of take-out leading rolls.

The upper roll 13 in the calender is a variable-crown roll, for example a roll adjustable in zones, having a bearing housing 131 attached directly to the calender frame 11. The axle of the variable-crown upper roll 13 is mounted in the bearing housing 131 and, in a conventional manner, the roll is provided with inside, inner or interior loading means, for example zone cylinders, by whose means the deflection of the roll mantle can be regulated in a desired way.

In a similar manner, the lower roll 14 in the calender is a variable-crown roll, in particular a roll adjustable in zones, having a mantle mounted to rotate about the roll axle and which roll 14 is provided with inner loading means, for example zone cylinders, by whose means the deflection of the roll mantle can be regulated in a desired way. The axle of the lower roll 14 is mounted in bearing housings 141, which have been mounted as shown in FIG. 1, on loading arms 142.

Loading arms 142 are attached to the calender frame 11 pivotally by means of articulated joints 143. Between the calender frame 11 and the loading arms 142, lower cylinders 144 are mounted, by whose means the lower roll 14 can be shifted in the vertical plane. Thus, the set of rolls 12 can be loaded by means of the lower cylinders 144, and further, by means of the lower cylinders 144, if necessary, it is possible to open the set of rolls 12. By means of the zone cylinders of the variable-crown upper and lower rolls 13, 14, in the method and the arrangement in accordance with the invention, a necessary correction and/or desired regulation of the cross-direction profile of the paper web W can be carried out.

Between the upper and the lower rolls 13,14 in the calender, a number of intermediate rolls 15–22, which are in nip contact with each other, are arranged as stated above. In the following, exclusively the uppermost intermediate roll 15 will be examined, and the related constructions are described in more detail with the aid of reference numerals. A corresponding description can also be applied to the other constructions of intermediate rolls in the calender. The intermediate roll 15 is mounted from its ends to revolve in bearing housings 151. Bearing housings 151 are mounted on lever arms 152, which in turn, are pivotally mounted on the calender frame 11 by means of articulated joints 153 arranged in the axial direction of the roll 15. The lever arms 152 are provided with support means 154, which are preferably hydraulic cylinders. Cylinders 154 are elongate and are attached at one end to the lever arms 152 and at an opposite end to the calender frame 11.

By means of the cylinders 154, a support force is applied to the support constructions of the roll 15 and by means of which force, the loads caused by the weights of the roll 15 and related auxiliary equipment, such as the takeout leading roll 155 (however, always at least the weight of the auxiliary equipment connected with the roll as added with the weight of the parts placed outside the web), can be compensated for and supported in the desired and/or necessary manner. The support can also be carried out so that the loads are supported completely, in which case the weights of the roll 15 and the connected auxiliary equipment have no effect on the nip load, i.e., do not increase the nip load. If such complete support is carried into effect in respect of all of the intermediate rolls 15–22, the linear load in each nip $N_1, \ldots, N_9$ can be made substantially equally high.

Figure 2C:
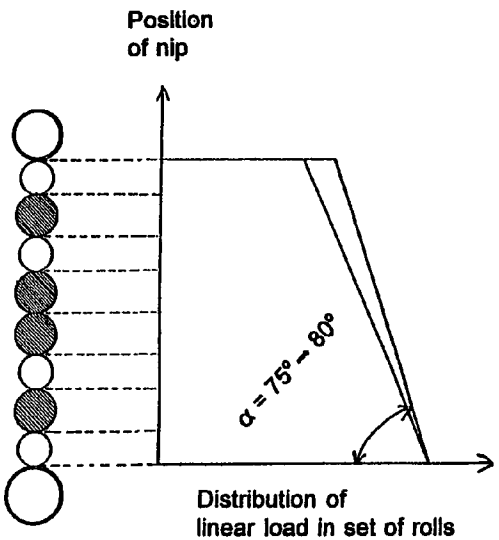
FIGS. 2A, 2B and 2C are exemplifying illustrations of the regulation of the distribution of linear load in the machine direction that can be achieved by means of the arrangement and method in accordance with the invention.
Figure 2B:
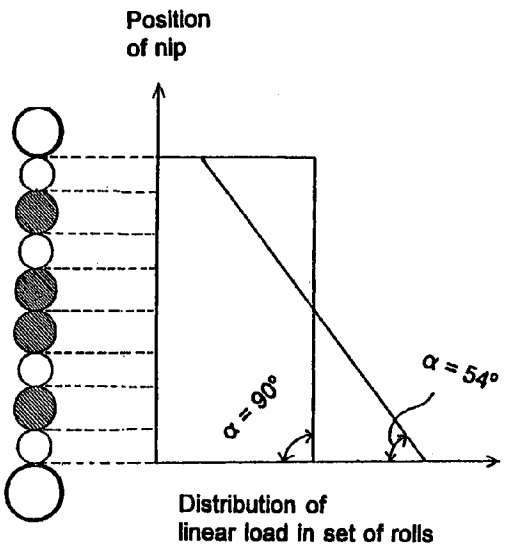
Figure 2A:
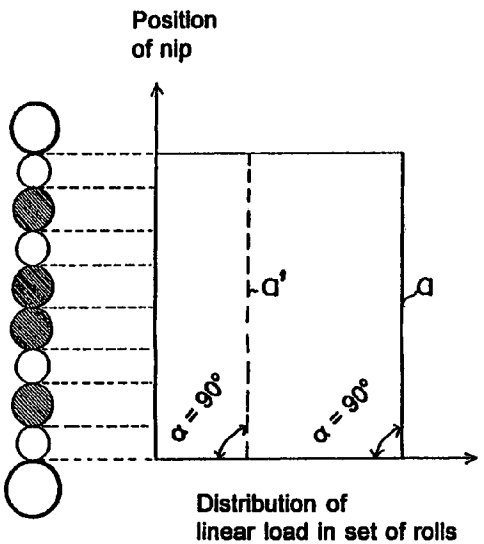

FIG. 2A is a schematic illustration of the situation of loading in the set of rolls, in which connection each nip $N_1, \ldots, N_9$ has an equally high linear load. In this connection, a new term is also introduced in calendering technique, i.e., the loading angle $\alpha$, because this novel mode of loading cannot be illustrated unequivocally in traditional ways. The loading angle $\alpha$ illustrates the distribution of linear load in the set of rolls from nip to nip, and in the case of FIG. 2A, i.e., in a case of complete relief, the loading angle $\alpha$=90°. By means of the loading angle $\alpha$ being about 90°, compared with conventional calenders, a significant increase in the calendering potential is obtained. This increase in calendering potential can be utilized in order to increase the running speed of the web through the calender and the productivity of the calender.

The magnitude of the linear load can be regulated fully freely in order to achieve the desired calendering effect, and, in particular in the case of "full relief", i.e., with a loading angle $\alpha$ of about 90°, the calendering effect can be regulated in the way illustrated in FIG. 2A by way of example. A high linear load and a high calendering effect a are employed in order to maximize the running speed of the calender, the productivity, and the paper quality. A low linear load and a low calendering effect a' are needed under different conditions and in different production stages, such as in matt calendering, in optimizing of quality, in stages of starting up and running down, and in situations of web break. By means of a, the solution in accordance with the present invention, a very low calendering effect can be achieved in each nip in the calender, as illustrated in FIG. 2A by way of example.

FIG. 2B illustrates a situation in which, in comparison to a calender with a conventional mode of loading in which the loading angle $\alpha$ is, e.g., about 54°, in a mode of running in accordance with the present invention, a loading angle $\alpha$=90° is employed. As indicated clearly by FIG. 2B, with a mode of running in accordance with the present invention, a significantly lower level of linear load is needed to produce similar properties of quality of paper, i.e., paper having the same properties. However, in accordance with the principles of the invention, it is possible, for example, to minimize the strain applied to the soft-faced rolls in the calender, such as polymer-coated rolls, in particular in the lower part of the set of rolls.

The loads produced by the mass of the intermediate rolls 15–22 in the set of rolls 12 and by the mass of the auxiliary devices connected with these rolls can, if necessary, also be relieved partially, or so that exclusively the pin loads are relieved, in which case, in respect of the distribution of linear load in the set of rolls, for example, a situation as shown in FIG. 2C is reached. As shown in FIG. 2C, the loading angle $\alpha$ can be adjusted, e.g., in a range from about 75° to about 80°. As a result, the linear loads are always increasing in the nips when moving towards a lower nip.

In conventional and traditional supercalenders, the loading angle has generally been in the range of from about 45° to about 55°, and the magnitude of this loading angle has been dependent on the size of the calender, i.e., mainly on the number of rolls. In the method in accordance with the present invention, the magnitude of the loading angle $\alpha$ can be adjusted quite freely, and by means of this adjustability of the loading angle, a considerable advantage and a remarkable improvement are achieved over earlier calendering constructions. The loading angle $\alpha$ can be used as an active variable in fine adjustment of the differences between different faces of the paper. Adjustment of two-sidedness has a significant effect on the properties of quality of paper, and in this manner, by means of the present invention, it is possible to produce paper of uniform quality reel after reel. A corresponding property has not been suggested anywhere else previously.

The support can, of course, also be accomplished, for example, as a what is called "excessive relief", wherein the loading angle $\alpha$ is larger than 90°. In such a case, it is possible to reach a situation in which a lower nip always has a lower linear load than the nip placed above has. Such an embodiment has, however, not been illustrated herein.

Figure 3A:
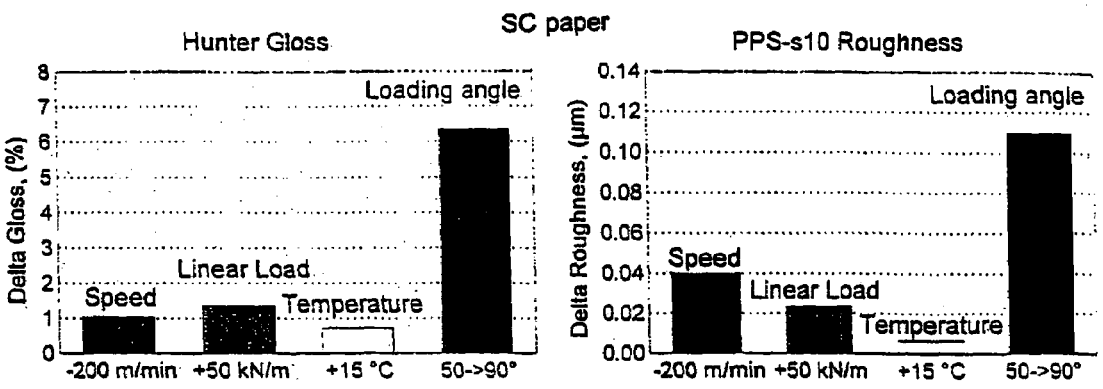
FIGS. 3A, 3B and 3C illustrate the effects of different calendering parameters on the surface properties of paper.
Figure 3B:
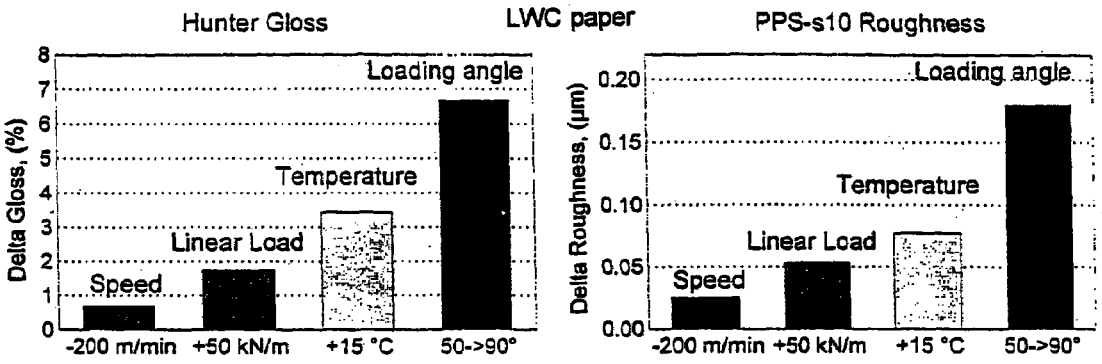
Figure 3C:
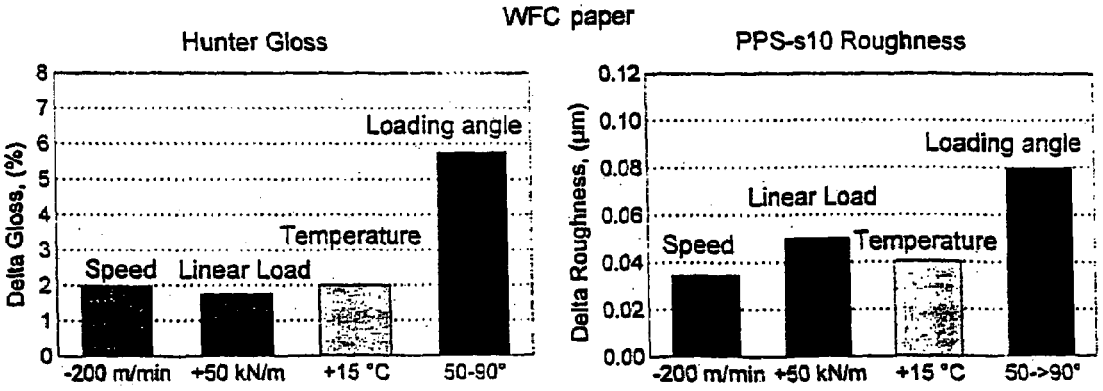
Figure 4:
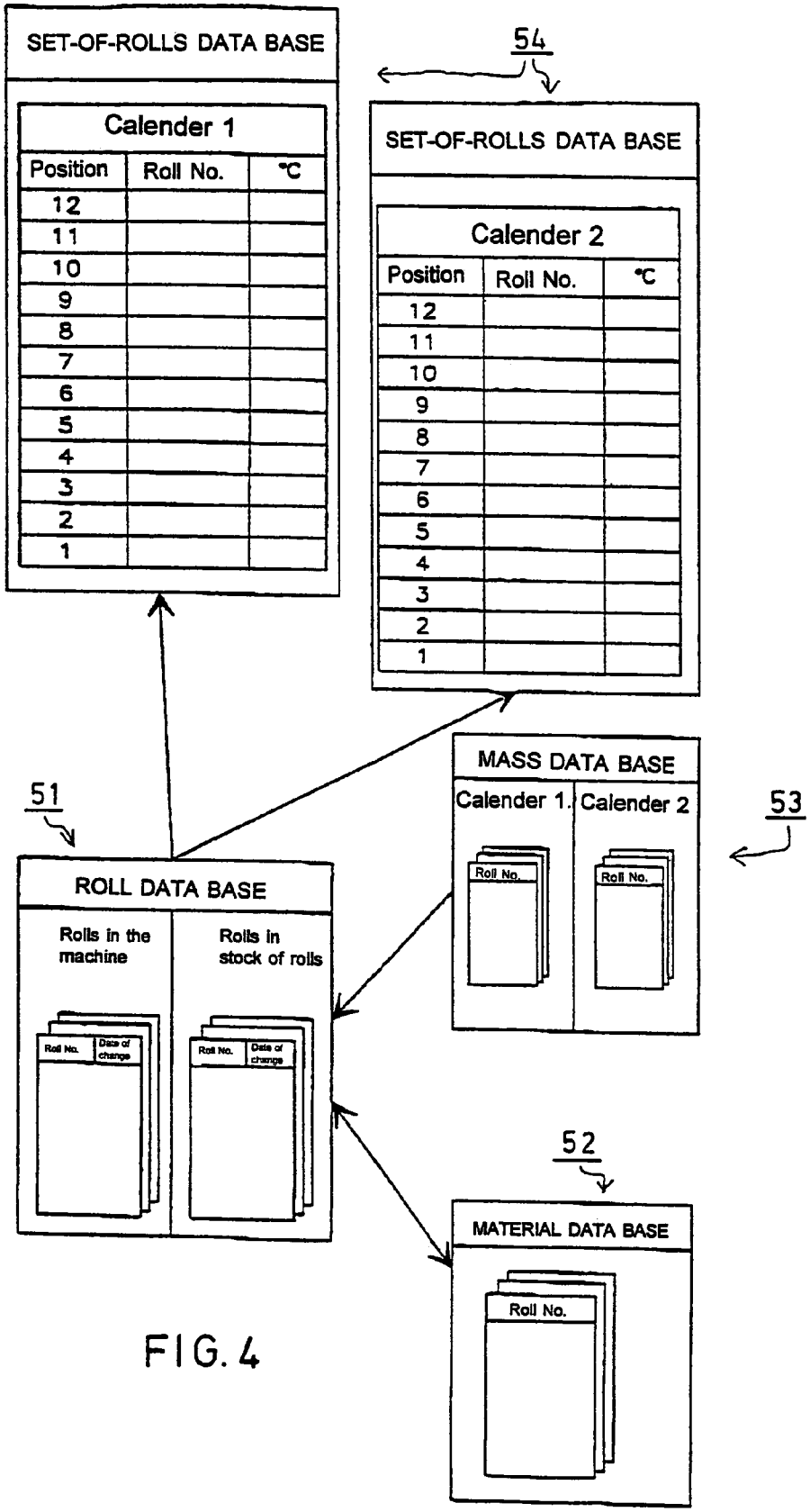
FIG. 4 is a schematic illustration of the relative arrangement of the data bases included in the automation arrangement in accordance with the invention.

In order to establish the significance of the loading angle $\alpha$ and its adjustability in comparison with other calendering parameters or variables, an extensive test program has been carried out with a test machine, and an example of the test results is given in FIGS. 3A, 3B and 3C, which illustrate the effects of different calendering parameters with different paper grades. In FIG. 3A, the paper grade is SC paper, in FIG. 3B, the grade is LWC paper, and in FIG. 3C, the grade is WFC paper. The effects of different factors on the surface properties of paper (gloss, roughness/smoothness) were determined by means of the results, which were obtained by changing the calendering parameters to a certain extent. The variables that were used were running speed, linear load, temperature, and loading angle, as follows:

Speed: change in speed about 200 meters per minute

Linear load: change in load about 50 kN/m

Temperature: change in surface temperature of heated roll about 15° C.

Loading angle: change in loading angle from about 50° to about 90° (50° represents the loading with a traditional mode of supercalendering, and 90° represents an angle which can be obtained with the method in accordance with the present invention)

As seen clearly from FIGS. 3A, 3B and 3C, the effect of a change in loading angle on improvement of the surface properties of paper is higher than with any other calendering parameter.

FIG. 1, and also FIGS. 2A, 2B and 2C, illustrate an embodiment in which the set of rolls 12 consisting of the rolls has been installed substantially vertically. The solution is, of course, not confined to such an embodiment only, but the set of rolls can be placed in an obliquely vertical position at least to some extent diverging from the straight, vertical position. Of the rolls included in the set of rolls 12, one or several may be soft-coated polymer rolls and/or paper rolls, fiber rolls or other soft-faced rolls. In the exemplifying embodiment shown in FIG. 1, the upper and lower rolls 13,14 are provided with a soft polymer coating, the first, third, sixth, and eighth intermediate rolls 15,17,20, and 22 are hard-faced chilled rolls, and the second, fourth, fifth, and seventh intermediate rolls 16,18,19,21 are soft-coated polymer rolls. The number of the intermediate rolls or the relative sequence and arrangement of the soft-faced/hard rolls is, however, in no way confined to the exemplifying embodiment of FIG. 1.

In the method in accordance with the present invention, a situation corresponding to a normal production situation is examined, in which case the set of rolls 12 is closed in the way shown in FIG. 1 and the rolls 13–22 are under load in contact with one another. As shown in FIG. 1, the automation system 30 included in the arrangement in accordance with the invention is connected to the support cylinders 154 to measure and control the loads of the relief cylinders. In the method to be examined, in the nips $N_1, \ldots, N_9$ in the set of rolls 12, in the running direction of the paper web W, a uniform or different, desired distribution of linear load is formed so that in the automation system 30 the deflection lines of the intermediate rolls 15–22 and the corresponding loads of the cylinders 154 of support of the intermediate rolls are computed. The support cylinders 154 and the lever arms 152 are used for supporting the mass of the intermediate rolls 15–22 and the masses of the auxiliary devices connected with the intermediate rolls.

As was already stated with reference to FIGS. 2A, 2B and 2C, the distribution of linear load in the machine direction is regulated by supporting the mass of the rolls and the connected auxiliary devices completely. Thus, besides the mass of the intermediate rolls, by means of the support cylinders 154 and the lever arms 152, the mass of the auxiliary devices connected with the lever arms of each intermediate roll, such as take-out leading rolls, possible doctors, etc., are also supported. The rigidities and mass of the intermediate rolls 15–22 are not equal from roll to roll. Correction of the errors in the cross-direction profiles of the deflection lines of the rolls, arising from these differences in rigidity and mass, i.e., regulation of the deflection lines of the intermediate rolls, is carried out by correcting the loads of the support cylinders of the intermediate rolls from their nominal value by means of the necessary term corresponding to the difference in pressure. The regulation of the deflection lines of the variable-crown upper roll and lower roll 13, 14 is carried out in a conventional manner by means of the zone cylinders in the rolls. When the deflection lines of the variable-crown upper and lower roll 13, 14 are regulated so that they are equal to the deflection lines of the intermediate rolls 15–22, it is possible to give the set of rolls 12 the desired level of linear load in the machine direction by hydraulically loading either the upper roll or the lower roll. In the case of FIG. 1, this loading can be arranged by means of the lower roll 14, because the loading cylinders 144 have been connected to act upon the lower roll.

In the method and the arrangement in accordance with the invention, the necessary correction and regulation of the cross-direction profile of paper, e.g., of thickness and/or glaze, is carried out by means of the zone cylinders in the variable-crown upper and lower roll 13,14. In the intermediate nips, i.e., in the nips $N_2, \ldots, N_8$ between the intermediate rolls 15–22, correction of the cross-direction profile can be carried out by means of regulation of the loading of the relief cylinders of the intermediate rolls. The method in accordance with the invention and the related computing of the distribution of the linear load in the set of rolls 12 can be applied both to a traditional mode of running of a multi-nip calender, wherein the paper web W runs through all of the nips $N_1, \ldots, N_9$, and to a modified mode of running, wherein the paper web W is passed through certain nips only. In the method in accordance with the invention, the automation system includes programs for maintenance of the set of rolls, distributions of linear load, roll parameters, and recipe data bases which, together with the program for computing the distribution of linear load, permit computing of the distributions of linear load specifically for each paper grade. Further, for maintaining the changes in the set of rolls in the calender and for monitoring the stock of rolls, there are program routines of their own.

The distribution of linear load in the set of rolls 12 and the support forces to be passed to the support cylinders of the intermediate rolls 15–22 are computed either in the automation system 30 or in a separate computing unit directly connected with the automation system. The computing model determines the rigidity and the mass distribution of the set of rolls 12 in the calender 10 consisting of chilled rolls and polymer rolls as well as the rigidity of the nips $N_1, \ldots N_9$ between the rolls. Further, in the computing, the locations and masses of the outside masses connected with the set of rolls are determined, the effect of temperature on the modulus of elasticity is taken into account, the effect of the roll diameters on the original modulus of elasticity is taken into account, a possible additional linear load of the rolls and the separate effects of the centers of mass and gravity of the roll ends at the tending side and at the driving side are taken into account. The data employed in computing are divided into general calender-specific, nip-specific, and roll-specific data. Thus, the starting-value data necessary for the computing are defined in a roll data base 51, in a roll material data base 52, in a set-of-rolls mass data base 53, in a data base of geometry of the articulated linkage in the calender, i.e., in the set-of-rolls data base 54, as illustrated schematically in FIG. 4. In the computing model applied in the invention, the computing is preferably carried out in two stages so that in the first stage, the support pressures of the intermediate rolls are optimized and correction coefficients are obtained for the variable-crown upper and lower rolls.

This data is utilized in the second stage of computing for optimizing the distribution of linear load of the upper roll and the lower roll.

The way in which the calender in accordance with the invention can be made to operate in the desired way, i.e., in which the forces that support the intermediate rolls are determined, is derived from the procedure in accordance with the invention, by whose means the ratio of the linear loads applied to the intermediate rolls, the weight of such rolls, and the support forces applied to such rolls is adjusted to such a level that a pre-determined state of deflection prevails in the area of the set of rolls. In the determination of the deflection of each roll, it is also possible to include a possible mode of grinding of the roll concerned, or the roll in nip contact with the same, to a shape different from the traditional cylindrical shape, such as a positive or negative crown.

When the basic load and the correction of linear load produced by means of the variable-crown rolls operating as end rolls are taken into account in the solution of the equations of deflection of the intermediate rolls, in every case it is possible to achieve such a state of equilibrium for the set of rolls that the distributions of linear load in the nips in the set of rolls correspond to the desired distribution of linear load.

The group of equations that has been formed and that illustrates the conduct of the set of rolls can be solved convergently by means of commonly used numeric solution algorithms of groups of equations. An example of this is FIG. 5, which illustrates a four-roll supercalender, in which the set of rolls 100 comprises a variable-crown lower roll 111, a variable-crown upper roll 112, and two intermediate rolls 113,114. The nip load in the nips $N_{101}$, $N_{102}$, $N_{103}$ between the rolls is produced substantially as the spring force required to produce an elastic compression of the coating on one of the rolls that form a nip. Since, at each point, the force is proportional to the difference between the transitions arising in the rolls at the nip, it can be concluded directly that at each point the same load is achieved when the difference in transition at the points is the same, i.e., when the deflection lines of the rolls are of equal shape and equal magnitude. Thus, the optimal relief or support of each roll is determined so that the bending load that remains on each roll mantle produces an equally high deflection on all rolls.

Figure 5:
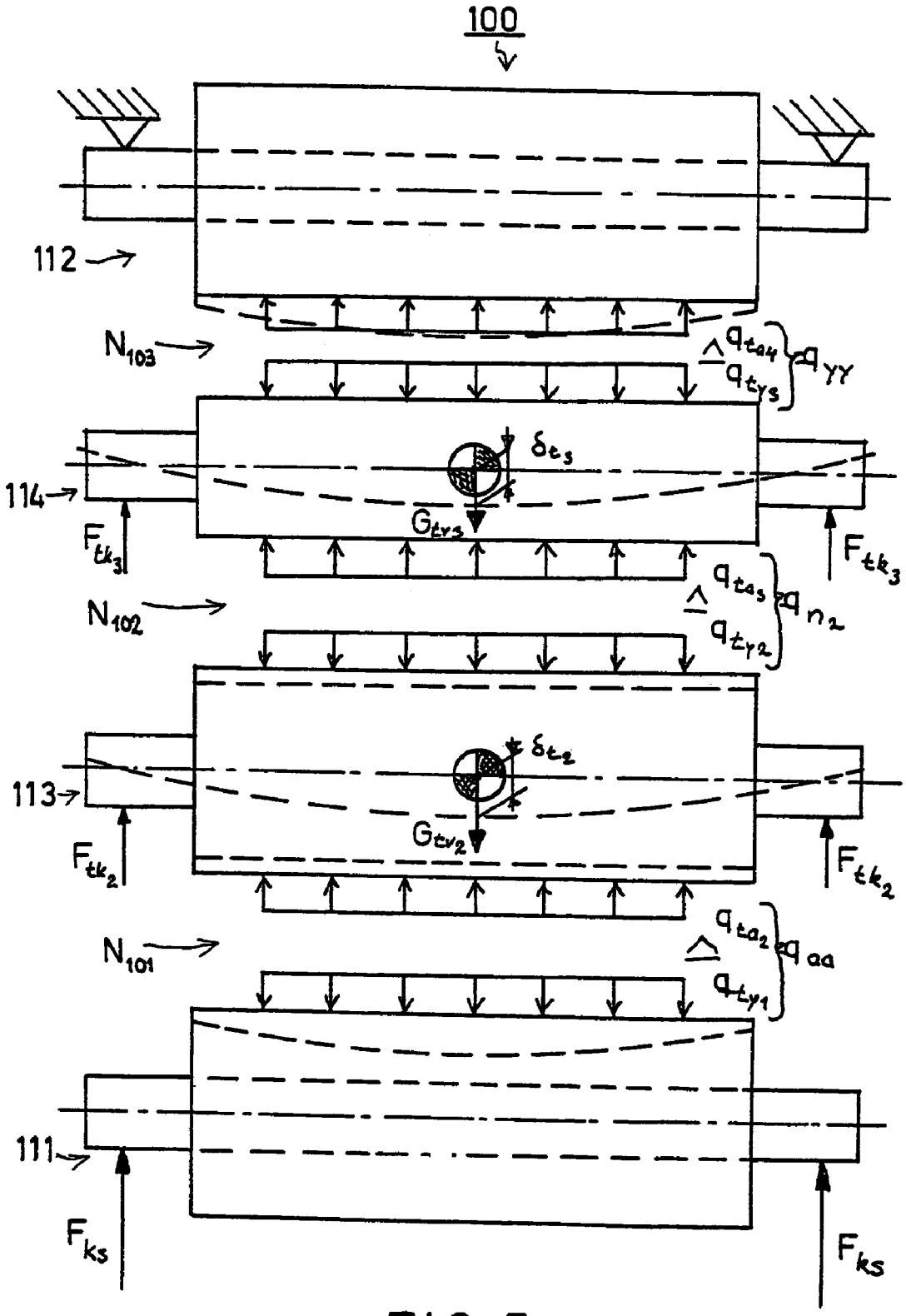
FIG. 5 is a schematic illustration of a four-roll calender that carries into effect the method in accordance with the invention.

Since normally, the deflection forms of rolls are equal (paraboloidal), in the examination referring to FIG. 5 the deflection of the roll will be described exclusively by means of the deflection of the center point of the roll.

The deflection of a roll as a result of a deflecting linear load produced on the roll mantle can be expressed by means of the formula:

$$\delta=k\cdot(q_{ts}/(E_t\cdot 1_t))$$

from which the load is obtained by means of the deflection:

$$q_{ts}=((E_t\cdot 1_t)/k)\cdot\delta_{t0}$$

wherein:

$\delta_t$=deflection of roll;

k=coefficient depending on mode of loading;

$q_{ts}$=linear load that deflects the roll;

$E_t$=modulus of elasticity of roll;

$1_t$=inertia of roll.

The sum of the loads that deflect the intermediate rolls in the whole set of rolls:

$$\Delta Q=\Sigma q_{ts}=\Sigma(((E_t\cdot 1_t)/k)\cdot\delta_{t-}$$

wherein:

ΔQ=change in overall load in the area of the set of rolls

The load deflects the roll mantle expressed by means of component loads:

$$q_{ts}=G_{tv}/L+q_{ty}-q_{ta}+q_{ti}$$

wherein $G_{tv}$=weight of roll mantle;

$q_{ty}$=linear load in upper nip of roll;

$q_{ta}$=linear load in lower nip of roll;

$q_{ti}$=additional linear load arising from other factors in the area of the roll mantle.

When it is taken into account that, in an intermediate nip between rolls, the upper and lower nip loads of adjacent rolls are of equal magnitude, the sum of the loads that deflect the intermediate rolls in the whole set of rolls is obtained as:

$$\Delta Q=\Sigma q_{ts}=\Sigma(G_{tv}/L)+q_{yy}-q_{aa}+\Sigma q_{ti}$$

wherein $q_{yy}$=linear load in the upper nip of the set of rolls $q_{aa}$=linear load in the lower nip of the set of rolls When the deflections of the rolls are denoted equal and when they are substituted further, what is obtained is:

$$\delta=\delta_t$$

$$\Rightarrow\Delta Q=\delta/k\cdot\Sigma(E_t\cdot 1_t)$$

$$\delta=\delta_t=o,=(\Delta Q\cdot k)/\Sigma(E^t\cdot 1_t)$$

When this is substituted further in the formula of the load that deflects a roll, what is obtained is:

$$q_{ts}=(E_t\cdot 1_t)/\Sigma(E_t\cdot 1_t)\cdot\Delta Q$$

Regarding the equilibrium of forces in a roll, the required support force per side is solved:

$$F_{tk}=\tfrac{1}{2}\cdot q_{ts}\cdot L+G_{tp}$$

$$\Rightarrow F_{tk}=\tfrac{1}{2}\cdot(E_t\cdot 1_t)/\Sigma(E_t\cdot 1_t)\cdot\Delta Q\cdot L+G_{tp}$$

wherein:

$F_{tk}$=support force of roll per side;

L=nip length;

$G_{tp}$=weight of end parts of roll per side.

The computing of the support forces of the set of rolls in the calender, expressly of the entire set of rolls, is based on knowledge of the exact physical properties of the rolls, i.e., the conduct of all the rolls is known when deflecting loads of different magnitudes are applied to the rolls. It is a basis of the computing that the bearing support forces applied to each roll are determined so that the entire set of roll obtains an equally high calculatory deflection. Thus, by means of regulation of the support forces, it is possible to affect the ratio of the upper nip load and the lower nip load at an individual roll so that the sum of these loads, together with the respective mass of the roll, produces the same predetermined deflection in each individual roll.

The computing can be applied to a set of rolls of any kind whatsoever in a calender, which set of rolls is placed in a substantially vertical position, in which set of rolls the upper roll is an adjustable-crown roll and the lower roll likewise an adjustable-crown roll, the axial distribution of support forces of the upper and lower roll being adjustable, and in which set of rolls there are at least two intermediate rolls between the upper roll and the lower roll. Further, it is an important requirement that all the rolls in the set of rolls are supported so that their deflection lines are downwards curved when the nips are closed.

It is an important characteristic feature of the method, the arrangement, and the calender in accordance with the invention that, when computing the linear loads in the set of rolls, the physical properties of each intermediate roll that affect the deflection under load, such as bending rigidity, mass, shape, and material properties, are taken into account.

It is a further property that the bearing support forces of the intermediate rolls are determined by means of computing so that the overall load applied to each intermediate roll subjects each intermediate roll substantially to a calculatory deflection such that the deflection forms of the contact faces of each roll, and the roll(s) in contact therewith in a nip, substantially correspond to one another.

The nip forces in a calender are regulated so that the difference between the nip forces of the uppermost nip and the lowest nip in the calender is determined to be at the desired level. This means, in fact, the regulation of the loading angle $\alpha$ that was described in relation to FIGS. 2A, 2B and 2C.

To briefly summarize the foregoing, it can be stated further that it is an important feature of the invention that all the intermediate rolls in the set of rolls are supported to a greater extent than what is required by the pin forces (all mass outside the web). In such a case, the deflection lines of the rolls are downwards curved and substantially paraboloidal (parabolic). The support forces of each intermediate roll are regulated so that the deflection of the roll is adapted to the shapes of the other rolls in the set of rolls. Thus, the computing is carried out by means of the deflections. In this way, a group of equations is obtained in which the basic load between the rolls is determined so that the deflections of all the rolls are substantially equal. Thus, an equilibrium of forces is produced in the set of rolls. As the loading angle $\alpha$, it is possible to use any loading angle whatsoever, and the regulation of the loading angle $\alpha$ is carried out by means of outside loading members through the lower roll and the upper roll. As a result, in the regulation of the deflection, the variable is the support force with which the roll is supported. Any errors produced by the mass of the areas outside the web in the distribution of linear load (and possibly other errors in the distribution of linear load) are corrected by means of the adjustable-crown upper and lower rolls.

Figure 6:
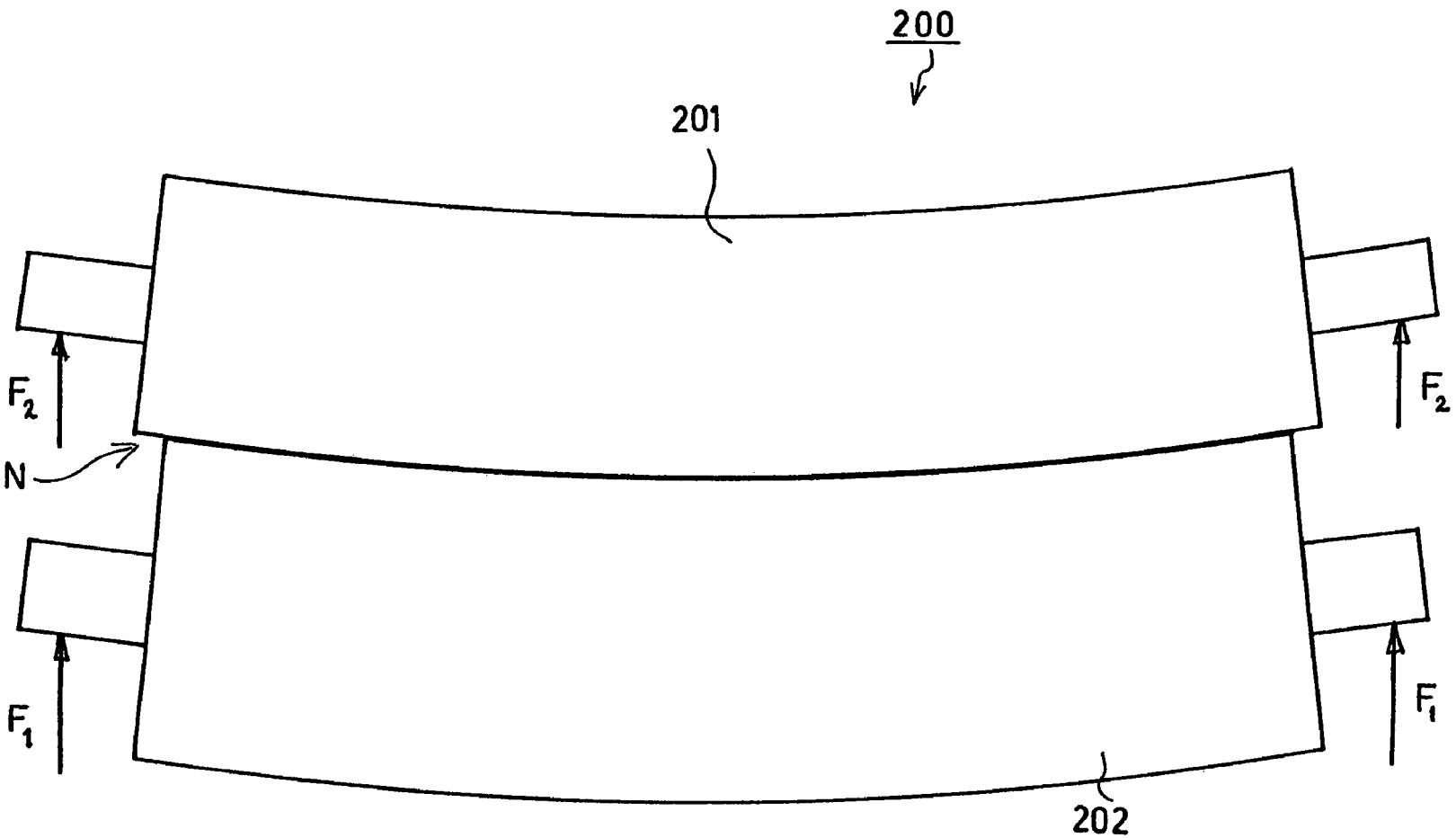
FIG. 6 is a schematic illustration of an alternative mode of loading in a multi-roll calender in which the set of rolls in the calender is treated by pairs of rolls.

As shown in FIG. 6, the invention provides a novel possibility of taking care of the loading and the regulation of loading in the set of rolls in a multi-roll calender by the pair of rolls, which makes the system of regulation simpler and easier to carry into effect. As described above, in conventional supercalenders, generally rolls of two different types are employed as intermediate rolls and the rigidities of these two roll types are different. More particularly, as the intermediate rolls, hard-faced heatable rolls are used, on one hand, and soft-faced rolls are used, on the other hand, which soft-faced rolls can be conventional paper rolls or fiber rolls, which have been formed by fitting disks made of paper or of some other fibrous material onto the roll axle. As soft-faced rolls, today, ever increasing use is made of polymer-faced rolls, in which the roll frame consists of a tubular roll mantle. The rigidities of rolls of the same roll type are substantially equal to one another, but as stated above, the roll types differ from one another essentially with respect to rigidity and thus, also with respect to the deflection arising from the own mass.

In a conventional supercalender, the set of rolls comprises a stack of rolls placed in a substantially vertical or obliquely vertical position, wherein the rolls rest one on the other and the pin loads applied to the bearing housings of the rolls have been relieved hydraulically. The loading and profiling of the set of rolls is taken care of by means of variable-crown upper and lower rolls.

In the alternative mode of loading shown in FIG. 6, the set of rolls is treated as pairs of rolls 200, which consist of a more rigid roll 202 placed as the lower half in the pair of rolls 200 and a more flexible roll 201 placed as the upper half. Any deflection arising from the mass of the upper roll 201 per se is higher than the deflection of the lower roll 202 in the pair. The pairs of rolls 200 in the set of rolls are substantially similar to one another, and they have equal, common deflections depending on the mass and rigidities of the rolls 201,202.

A force F2 is applied to the bearing housings of the upper and more flexible roll 201 in the pair of rolls 200, for example a hydraulic force, and by whose means, besides relief of the pin loads, any error in the distribution of linear load between the rolls may be compensated for. Such errors might arise from the different rigidities of the rolls 201,202. This can be illustrated by means of the formula:

$$2F_2=m_{add2},$$

wherein:

$F_2$=force applied to the bearing housings of upper roll;

$m_{add2}$=mass of the bearing housings and the auxiliary devices attached to the bearing housing as well as the above error arising from different rigidities of the rolls.

Thus, the upper roll 201 rests with its own weight $m_2$ (from which the pin loads have been "cleaned") on the lower roll 202 and applies an even linear load $m_2/L$ to the lower roll, wherein L is the axial length of the nip N between the rolls 201,202. On the other hand, a force $F_1$ is applied to the bearing housings of the lower roll 202 in the pair of rolls 200, by means of which force the mass of both rolls 101,102 in the pair of rolls 200 as well as the pin loads of the lower roll 202 are supported. This can be illustrated by means of the formula:

$$2F_1=m_1+m_2+m_{add1},$$

wherein:

$F_1$=force applied to the bearing housings of the lower roll;

$m_1$=mass of lower roll;

$m_2$=mass of upper roll;

$m_{add1}$=mass of the bearing housings of the lower roll and the auxiliary devices attached to the bearing housings.

Thus, in an optimal situation, between the separate pairs of rolls 200, no forces arising from the mass of the rolls are effective at all. In the nip N between the rolls 201,202 of the pair of rolls 200, exclusively the linear load arising from the mass of the upper roll 201 is effective, for example about from about 10 to about 20 kN/m. Owing to the differences between individual rolls, the whole set of rolls must be treated as a whole, and the reliefs of each roll must be optimized so that the cross-direction profile of linear load of the whole unit is as straight as possible and the linear load arising from the mass of the rolls is as low as possible. In this manner, a set of rolls with almost uniform loading is obtained, which set of rolls is, in most other respects, loaded in the manner described above. For example, when a load of about 300 kN/m is 1 considered as the load level, in every second nip there is a difference in loading of about 5 percent only, as compared with the preceding or the following nip, i.e., with existing rolls, a substantially even distribution of load is achieved.

Above, in connection with the description related to FIG. 6, for the sake of simplicity, it has been assumed that the rigidities of the rolls 201,202 in the pair of rolls 200 are at a certain ratio to one another and that the rigidities of the rolls belonging to the same type of rolls are substantially equal to one another. However, as established above in relation to FIG. 5 clearly by means of computing, there would not seem to exist any limitation arising from the mutual ratios of the extents of specific deflections of the rolls. Thus any ratio of the rigidities of two rolls whatsoever can be compensated by means of computing so that the magnitudes of the linear loads in the whole set of rolls can be regulated so that they become substantially equal, with the exception of the deviation caused by the internal nips in calculatory pairs of rolls. When conventional upper and lower rolls, for example rolls adjustable in zones, are used, a factor that limits uniform loading is the overall deflection of the intermediate rolls. This limitation could, however, be compensated for so that, if necessary, the lower roll is ground so that its diameter is smaller at the middle than at the ends (negative crown), so that the attainable maximal deflection of the roll adjustable in zones, together with the grinding shape, achieves the maximal possible deflection of the set of rolls. In this connection, it should be noted that, in a set of rolls of this type, the general direction of deflection of the rolls differs in such a way from the direction of deflection of so-called conventional supercalenders that the rolls are in a downwards curved position, instead of the upward curve form employed in a conventional supercalender.

Figure 7C:
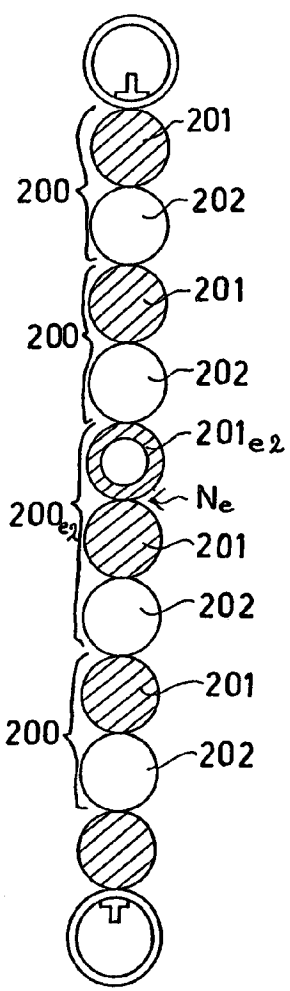
FIGS. 7A, 7B and 7C are schematic side views illustrating alternative embodiments of the set of rolls in a multi-roll calender in which a mode of loading described in relation to FIG. 6 is employed.
Figure 7B:
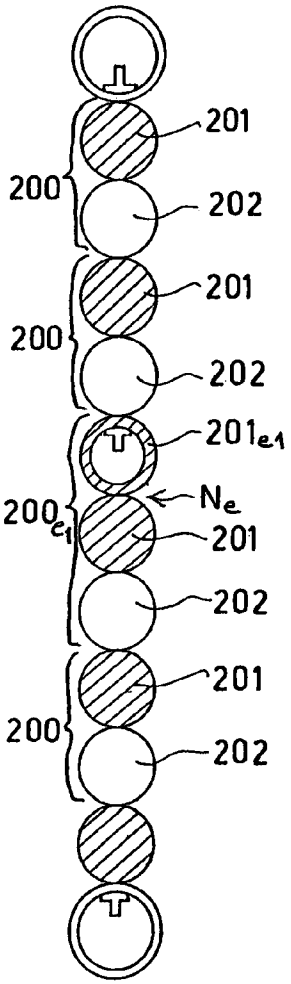
Figure 7A:
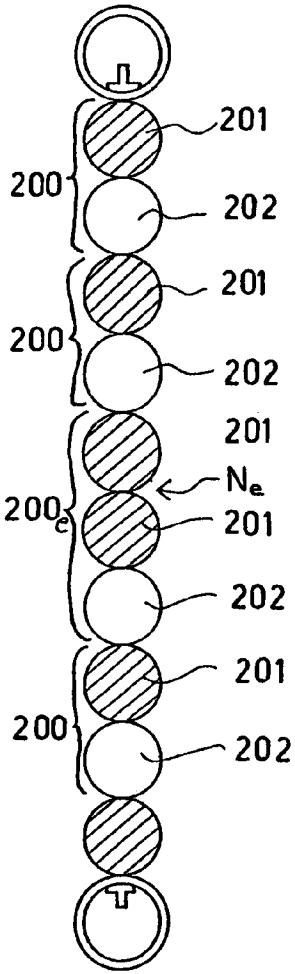

In the regulation of loading carried out by the pair of rolls, in the set of rolls in a supercalender, compared with the illustration of FIG. 6, a difference is caused by the reversing nip in the calender, i.e., the nip in which the side of calendering of the web is changed. Generally, this reversing nip is the middle nip in the supercalender. This is illustrated in FIGS. 7A, 7B and 7C, in which three alternative modes of loading in a reversing nip are shown. In these figures, the pairs of rolls as shown in FIG. 6 and identical with one another are denoted by reference numeral 200. In a supercalender, the reversing nip is a nip that is formed between two soft-faced rolls 201, and in FIGS. 7A, 7B and 7C this reversing nip is denoted by $N_e$.

In the embodiment shown in FIG. 7A, this has been accomplished so that, in the "pair" of rolls $\mathbf{200}_e$, which is in this case formed by three rolls placed one above the other, the lower roll 202, which is a hard-faced and, for example, heatable roll, has a higher rigidity than the lower rolls in the other pairs of rolls 200. This is because the mass of the two upper rolls 201 rest on the lower roll 202.

In FIG. 7B, a corresponding construction has been accomplished so that the upper soft-faced roll $\mathbf{201}_{e1}$ in the reversing nip $N_e$ is arranged as a variable-crown roll. In such a construction, the deflection of the roll $\mathbf{201}_{e1}$ is corrected by means of the crown variation means situated in the interior of the roll, and the mass of the roll does not load the pair of rolls $\mathbf{200}_{e1}$ placed underneath by means of its weight.

In FIG. 7C, a corresponding construction has been accomplished so that the upper soft-faced roll $\mathbf{201}_{e2}$ in the reversing nip $N_e$ has been arranged as a roll with such a rigidity that its deflection is the same as the deflection of the whole pair of rolls $\mathbf{200}$,$\mathbf{200}_{e2}$. In such a case, the roll in the reversing nip does not cause any problem in the regulation of the loading.

Figure 8:
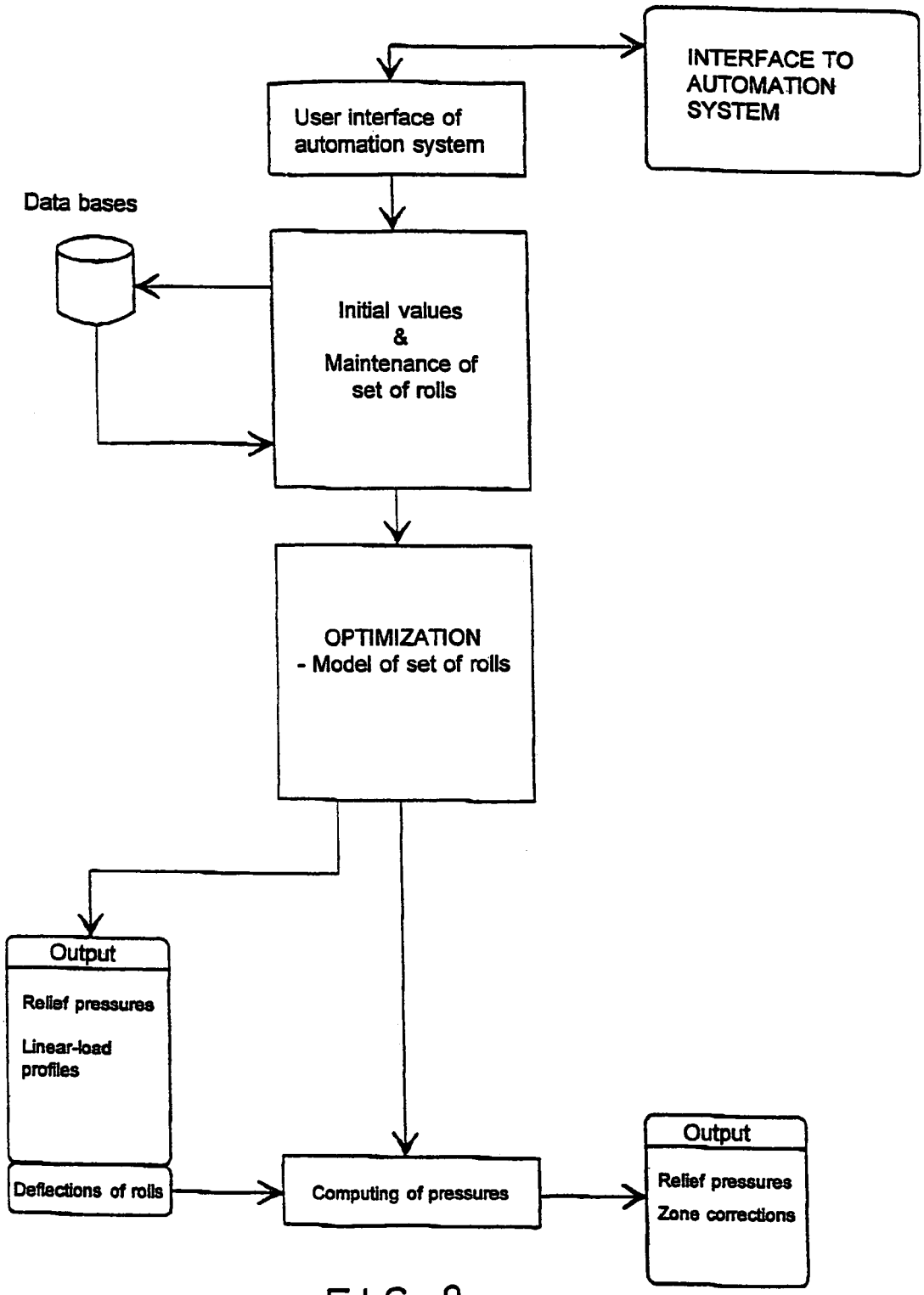
FIG. 8 shows a schematic block diagram that illustrates a model of computing in the arrangement in accordance with the invention.

With reference to FIG. 8, in the computing, in accordance with the invention, first the initial values of the rolls are defined, and a mathematical model corresponding to the set of rolls is formed on this basis. The mathematical model is formed in compliance with the number of rolls included in the set of rolls. The optimization computing formed for the set of rolls uses these data as the starting data. In the optimization computing that is to be carried out, the nip errors of the intermediate rolls are minimized, which errors have been defined as deviations from the nominal form. The resilience occurring between each nip and arising from the paper and from the coatings is illustrated by a base constant, which is computed across the nip length. The effects of the forces to be optimized on the linear load are determined in a response data base, in which the unit response of the element of the nip of each intermediate roll is indicated in a desired number of examination points. The effects of invariable forces on the linear load are determined in a separate invariable-force data base, which takes into account divided masses, point masses, and nips with invariable load. Further, for the computing, the effects of the forces to be optimized on the restrictions and the effects of backup forces on the tension restrictions are determined. Thus, the optimization becomes a mathematical problem, in which the variables are limited and determined by groups of equations. As a result of the computing, optimal relief forces for intermediate rolls, optimal profiles of linear load and deflections of rolls are obtained.

After the computing operation, the optimized support forces of the intermediate rolls in the set of rolls of the calender are transferred to the support cylinders of intermediate rolls, as illustrated, for example, in FIG. 1. The optimized support forces of intermediate rolls are also transferred to the program of computing of the zone pressures of the variable-crown upper and lower rolls. The deflection values of the intermediate rolls in the set of rolls are used for controlling and regulating the variable-crown upper and lower rolls. From the deflection values of the intermediate rolls, by means of a separate computing program, the zone pressure corrections of the upper and the lower roll are determined, which corrections are, in each particular case, added to, or reduced from, each actual value of zone pressure. The distribution of linear load in the set of rolls is controlled in the method in accordance with the invention so that, by means of the user interface of the automation system, first the desired form of the distribution of linear load is determined. After this, the automation system and the included computing programs compute the above set values for the support pressures of the intermediate rolls and the zone pressures of the variable-crown upper and lower rolls. The method in accordance with the invention also takes into account situations of change in the set of rolls arising from change of roll or from a new mode of running as well as any changes arising from such situations of change in the set-of-rolls data base, the parameter data bases and the computing. Likewise, in its roll and material data bases, the method covers and takes into account situations in which the diameters and/or material properties of chilled rolls and/or polymer rolls are changed.

With regard to the process conditions of calendering, it can be stated generally that they are determined by the capacities of the components that are used as rolls, as is also ordinary in calender technology. Further, restrictive factors in the process include the desired properties of paper, such as bulk (stiffness), smoothness/roughness, and gloss, in particular gloss of printing paper. As examples of process conditions, reference is made to U.S. Pat. Nos. 4,749,445 and 4,624,744 by S. D. Warren. A possible range of surface temperature of a heatable, so-called thermo roll is $T_s$=about 60° C. to about 250° C., depending on the running speed so that the surface temperature is lower at low running speeds and higher at high running speeds. This is because the time of effect of the nip is shorter and thus, the transfer of heat from the thermo roll to the web face is lower. The range of variation of linear load can be from about 20 kN/m to about 550 kN/m or even higher, again depending on the running speed and the properties of the variable-crown upper and lower rolls that produce the linear load in the supercalender.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. In a method for computing and regulating the distribution of linear load in a multi-nip calender in which a material web is passed through the nips, the nips being defined by a set of rolls arranged in a substantially vertical position and including a variable-crown upper roll, a variable-crown lower roll, the variable-crown upper roll and variable-crown lower roll being structured and arranged to selectively apply a load to at least two intermediate rolls arranged between the upper roll and the lower roll, said at least two intermediate rolls being provided with support cylinders, all of the rolls in the set of rolls being supported such that, when in nip-defining relationship, the rolls have bending lines which are curved downward, the improvement comprising the steps of:

assigning a value to at least one variable representing a physical property affecting the bending of each of said at least two intermediate rolls;

applying a first force to said at least two intermediate rolls by means of said variable-crown upper roll;

applying a second force to said at least two intermediate rolls by means of said variable-crown lower roll;

applying a support force to each one of said at least two intermediate rolls by means of said support cylinders;

adjusting at least one of the following to place the set of rolls in a state of equilibrium and a predetermined state of deflection:

the first force, the second force, at least one of the support forces and at least one of weight forces exerted on each of said at least two intermediate rolls; and wherein the step of assigning a value to at least one variable representing a physical property affecting the bending of each of said at least two intermediate rolls comprises the step of assigning a value to bending rigidity, mass, shape, and material of each of said at least two intermediate rolls; and further comprising computerized modeling using all essential elements of the multi-nip calender including all physical properties of the set of rolls and selecting a type and a position of each roll in the set of rolls;

determining of regulation parameters based on the computerized modeling;

regulating of the multi-nip calender assembled based on the computerized model assembled with the type and the position of each roll in the set of rolls.

2. The method of claim 1, wherein said at least one physical property is selected from a group consisting of bending rigidity, mass, shape, and material.

3. The method of claim 1, further comprising the step of:

providing each one of said at least two intermediate rolls with different deflection properties.

4. The method of claim 1, further comprising the step of:

treating the set of rolls as a single unit when adjusting the at least one of the first force, the second force, at least one of the support forces and at least one of the weight forces exerted on each of said at least two intermediate rolls.

5. The method of claim 1, further comprising the step of:

supporting said at least two intermediate rolls on a frame of the calender such that said at least two intermediate rolls are freely movable.

6. The method of claim 1, wherein the at least one of the first force, the second force, at least one of the support forces and at least one of the weight forces exerted on each of said at least two intermediate rolls is such that a loading angle is about 90°, the loading angle being defined as the distribution of linear load in the set of rolls from nip to nip.

7. The method of claim 1, wherein the at least one of the first force, the second force, at least one of the support forces and at least one of the weight forces exerted on each of said at least two intermediate rolls is regulated such that a loading angle is adjustable in a range from about 75 to about 80, the loading angle being defined as the distribution of linear load in the set of rolls from nip to nip.

8. The method of claim 1, prior to the adjusting step further comprising the step of:

calculating a linear load force applied to each one of said at least two intermediate rolls.

9. In an arrangement for computing and regulating the distribution of linear load in a multi-nip calender in which a material web is passed through the nips, the nips being defined by a set of rolls arranged in a substantially vertical position, comprising:

a variable-crown upper roll, a variable-crown lower roll, at least two intermediate cylinders, said at least two intermediate cylinders positioned between said variable crown upper roll and said variable crown lower roll, wherein the variable-crown upper roll applies a first force to said at least two intermediate cylinders and variable-crown lower roll applies a second force to said at least two intermediate cylinders, said at least two intermediate rolls being provided with support cylinders, said support cylinders applies a support force to each one of said at least two intermediate rolls and wherein the set of rolls being supported such that, when in nip-defining relationship, the set of rolls have bending lines which are curved downward, an automation system and a computing unit for assigning at least one value to a variable representing a physical property affecting the bending of each of said at least two intermediate rolls and for adjusting at least one of the following to place the set of rolls in a state of equilibrium and a predetermined state of deflection:

the first force, the second force, at least one of the support forces and at least one of weight forces exerted on each of said at least two intermediate rolls; and wherein the at least one physical property affecting the bending of each of said at least two intermediate rolls is bending rigidity, mass, shape, and material of each of said at least two intermediate rolls;

wherein the computing unit defines a computerized model using all essential elements of the multi-nip calender including all physical properties of the set of rolls and a type and a position of each roll in the set of rolls is selected;

wherein the automation system regulates the multi-nip calender based on the computerized model assembled with the type and the position of each roll in the set of rolls.

10. The arrangement of claim 9, wherein each one of said at least two intermediate rolls has different deflection properties.

11. The arrangement of claim 9, wherein the set of rolls is treated as a single unit.

* * * * *